US007179576B2

(12) United States Patent
Ueda et al.

(10) Patent No.: US 7,179,576 B2
(45) Date of Patent: Feb. 20, 2007

(54) TONER AND PRODUCTION PROCESS FOR THE SAME

(75) Inventors: Hideaki Ueda, Hachioji (JP); Mitsutoshi Nakamura, Hino (JP); Noboru Ueda, Hachioji (JP); Yasumitsu Fujino, Akishima (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 322 days.

(21) Appl. No.: 10/791,803

(22) Filed: Mar. 4, 2004

(65) Prior Publication Data

US 2005/0136354 A1 Jun. 23, 2005

(30) Foreign Application Priority Data

Dec. 17, 2003 (JP) ..... 2003-419814

(51) Int. Cl.
*G03G 9/08* (2006.01)

(52) U.S. Cl. ..... 430/110.2; 430/108.1; 430/137.11; 430/137.21

(58) Field of Classification Search ..... 430/110.2, 430/108.1, 137.11, 137.21
See application file for complete search history.

(56) References Cited

U.S. PATENT DOCUMENTS

| | | | | |
|---|---|---|---|---|
| 4,828,955 | A | 5/1989 | Kasai et al. | |
| 5,204,205 | A * | 4/1993 | Anno et al. | 430/110.2 |
| 6,686,112 | B2 | 2/2004 | Teshima et al. | |
| 6,906,801 | B2 | 6/2005 | Borden et al. | |
| 2001/0033982 | A1* | 10/2001 | Ishikawa et al. | 430/110.1 |
| 2002/0039699 | A1 | 4/2002 | Nishimori et al. | |
| 2002/0160289 | A1 | 10/2002 | Teshima et al. | |
| 2004/0119978 | A1 | 6/2004 | Borden et al. | |

FOREIGN PATENT DOCUMENTS

| | | | |
|---|---|---|---|
| JP | 63-240937 | A | 6/1988 |
| JP | 2-62558 | A | 3/1990 |
| JP | 2001-324831 | A | 11/2001 |
| JP | 2002-229251 | | 8/2002 |

* cited by examiner

*Primary Examiner*—Mark A. Chapman
(74) *Attorney, Agent, or Firm*—Buchanan Ingersoll & Rooney PC

(57) ABSTRACT

A toner includes core particles containing a resin and a colorant, and a coating layer formed over the core particles. The coating layer includes at least one type of coating particles selected from the group consisting of wax-containing resin microparticles containing a resin and a wax, and colorant-containing resin microparticles containing a resin and a colorant, the coating particles fusion-bonded to the surface of the core particles.

13 Claims, No Drawings

TONER AND PRODUCTION PROCESS FOR THE SAME

RELATED APPLICATION

The present invention is based on Japanese Patent Application No. 2003-419814, the content of which is incorporated by reference.

BACKGROUND OF THE INVENTION

1. Field of the Invention

The present invention relates to a toner and a production process for the same, the toner used for developing an electrostatic image formed on a photosensitive member provided in an image forming apparatus such as copiers and printers. More particularly, the invention relates to a toner which includes core particles containing at least a resin and a colorant and coated with a coating layer, and to a process for producing the toner.

2. Description of the Related Art

The image forming apparatuses such as copiers and printers have conventionally used a toner for developing an electrostatic image formed on the photosensitive member.

A milling process is widely used for producing such a toner. The process includes the steps of: admixing additives including a colorant, a wax and the like to a resin; heat melting the mixture and kneading the molten mixture; cooling the kneaded product; and milling the product into toner particles of a predetermined particle size.

Recently, for power saving purpose and such, the above image forming apparatuses have adopted the practice of fixing a toner image formed on a recording medium at lower temperatures and adequately fixing the toner image to the recording medium without using an oil. The practice dictates the need to admix an increased amount of wax to the aforesaid toner.

Furthermore, the aforesaid toner also need be admixed with an increased amount of colorant in order to ensure the formation of images having a sufficient image density.

In a case where the toner is produced by the aforementioned milling process, however, the following problem exists. If the toner is admixed with greater amounts of wax and colorant, the toner suffers increased amounts of wax and colorant exposed to toner surface. This results in serious degradation of the chargeability and the like of the toner.

More recently, a granulation process in a wet system, such as a suspension polymerization process, an emulsion dispersion process and an emulsion polymerization/flocculation process, has attracted attention as a toner production process.

Unfortunately, in a case where the toner is produced by such a granulation process in the wet system, it is impossible to put defective products to reuse for toner production and hence, the production cost is increased. Furthermore, the toner production using this method also involves the problem. That is, if the wax and colorant are added in greater amounts, the toner suffers the increased amounts of wax and colorant exposed to the surface thereof. Hence, the toner is seriously degraded in the chargeability and the like.

More recently, there has been proposed a method which uses a salting-out/fusion-bonding process or the like for fusion-bonding resin microparticles to the surface of core particles in a wet system thereby forming a coating layer over the core particles containing a resin, a colorant and the like (see, for example, U.S. Patent Application Publication US 2002/0039699 and Japanese Unexamined Patent Publication No. 2002-229251).

However, where the salting-out/fusion-bonding process is used for fusion-bonding the resin microparticles to the core particle surface in the wet system thereby forming the coating layer thereover, various problems are encountered. That is, water, dispersant and the like remain in the toner so that the toner is reduced in the chargeability. In addition, the aforesaid coating layer suppresses the functions of the wax and colorant so that the toner is reduced in fixing performance or cannot provide a sufficient image density.

SUMMARY OF THE INVENTION

The invention is directed to solution to the aforementioned problems encountered by the toner used for developing the electrostatic image formed on the photosensitive member of the image forming apparatuses, such as copiers and printers.

Specifically, an object of the invention is to prevent a heavy exposure of the wax or colorant to the toner particle surface or to prevent water, the dispersant or the like from remaining in the toner, thereby reducing the degradation of the chargeability of the toner.

Another object of the invention is to permit the wax and colorant added to the toner to fully exert their functions, thereby improving the fixing performance of the toner and ensuring the formation of images having a sufficient image density.

A first toner according to the invention comprises core particles containing a resin and a colorant, and a coating layer formed over the core particles, the coating layer comprising at least one type of coating particles selected from the group consisting of wax-containing resin microparticles containing a resin and a colorant, and colorant-containing resin microparticles containing a resin and a colorant, the coating particles fusion-bonded to the surface of the core particles.

A second toner according to the invention comprises core particles containing a resin and a colorant, and a coating layer formed over the core particles, the coating layer comprising at least one type of coating particles selected from the group consisting of wax microparticles and colorant microparticles and made to adhere to the surface of the core particles, and coating particles of resin microparticles fusion-bonded onto the attached coating particles.

According to the first and second toners, the coating layer is formed by fusion-bonding in a dry system at least one type of coating particles selected from the group consisting of the wax-containing resin microparticles containing at least the resin and the wax, and the colorant-containing resin microparticles containing at least the resin and the colorant.

According to the first toner, it is preferred to form the second coating layer of a resin over the aforesaid coating layer.

According to the second toner, the coating layer containing the wax and/or the colorant is formed over the core particles containing at least the resin and the colorant by the steps of: making at least one type of coating particles to adhere to the surface of the core particles in a dry system, the coating particles selected from the group consisting of the wax microparticles and the colorant microparticles; and further fusion-bonding thereto the coating particles of resin microparticles.

In the production of the first toner, the first coating layer is formed over the core particles in the dry system by fusion-bonding thereto at least one type of coating particles selected from the group consisting of the wax-containing resin microparticles containing at least the resin and the wax, and the colorant-containing resin microparticles containing at least the resin and the colorant.

In the production of the second toner, the coating layer containing the wax and/or the colorant is formed over the aforesaid core particles by making at least one type of coating particles to adhere to the surface of the core particles in the dry system, the coating particles selected from the group consisting of the wax microparticles and the colorant microparticles, and then, fusion-bonding thereto the coating particles of the resin microparticles in the dry system.

According to the first toner of the invention, the coating layer is formed over the core particles containing at least the resin and the colorant by, as described above, fusion-bonding thereto at least one type of coating particles in the dry system, the coating particles selected from the group consisting of the wax-containing resin microparticles containing at least the resin and the wax, and the colorant-containing resin microparticles containing at least the resin and the colorant. Therefore, the toner is reduced in water, dispersant and such remaining therein so that the toner is less prone to degradation of the chargeability.

According to the first toner, the aforesaid coating layer incorporates therein the wax of the wax-containing resin microparticles or the colorant of the colorant-containing resin microparticles. Therefore, the wax present in the coating layer contributes to the improvement of the fixing performance of the toner whereas the colorant present in the coating layer ensures the formation of the image having a sufficient image density.

According to the first toner, the second coating layer may be formed over the aforesaid coating layer by fusion-bonding thereto the coating particles of resin microparticles in the dry system. Thus, the second coating layer prevents the wax or colorant present in the aforesaid coating layer from being exposed to the toner surface. Hence, the toner is more positively prevented from suffering the degraded chargeability and such.

According to the second toner of the invention, the coating layer containing the wax and/or the colorant is formed over the core particles containing at least the resin and the colorant by, as described above, making at least one type of coating particles to adhere to the core particles in the dry system, the coating particles selected from the group consisting of the wax microparticles and the colorant microparticles and then, fusion-bonding thereto the coating particles of the resin microparticles in the dry system. Therefore, likewise to the aforementioned first toner, the toner is reduced in water, dispersant and such remaining therein so that the toner is less prone to degradation of the chargeability.

Likewise to the aforementioned first toner, the second toner also offers the following advantages by virtue of the wax or the colorant present in the coating layer. That is, the wax contained in the coating layer contributes to the improvement of the fixing performance of the toner, whereas the colorant present in the coating layer ensures the formation of the image having a sufficient image density.

According to the second toner, the coating layer is formed over the core particles by, as described above, making at least one type of coating particles to adhere to the core particle surface, the coating particles selected from the group consisting of the wax microparticles and the colorant microparticles, and then, fusion-bonding thereto the coating particles of the resin microparticles in the dry system. Therefore, the wax or colorant is prevented from being exposed to the toner surface so that the toner is more positively prevented from suffering the degraded chargeability and such.

These and other objects, advantages and features of the invention will become apparent from the following description thereof taken in conjunction with the accompanying drawings which illustrate specific embodiment of the invention.

DESCRIPTION OF THE PREFERRED EMBODIMENTS

A toner and a production process for the same according to the invention will be described as below.

A toner according to a first embodiment of the invention comprises core particles containing at least a resin and a colorant, and a coating layer formed over the core particles by fusion-bonding thereto at least one type of coating particles in a dry system, the coating particles selected from the group consisting of wax-containing resin microparticles containing at least a resin and a wax, and colorant-containing resin microparticles containing at least a resin and a colorant.

According to the first toner, it is preferred to form a second coating layer over the foresaid coating layer by fusion-bonding thereto coating particles of resin microparticles in a dry system.

A toner according to a second embodiment of the invention comprises core particles containing at least a resin and a colorant, and a coating layer formed over the core particles by making at least one type of coating particles to adhere to the core particle surface in a dry system, the coating particles selected from the group consisting of wax microparticles and colorant microparticles, and then, fusion-bonding thereto coating particles of resin microparticles in the dry system.

If the aforesaid coating layer of the first or second toner contains the wax in an insufficient amount, the toner cannot be improved in the fixing performance. If, on the other hand, the wax is present in an excessive amount, the toner is prone to aggregation and is also decreased in chargeability. It is therefore preferred to admix the wax in an amount of 1 to 50 wt % based on the overall coating layer(s). In a case where the first coating layer is formed over the core particles by fusion-bonding thereto the wax-containing resin microparticles containing the wax, as suggested by the aforesaid first toner, a wax content of the first coating layer may preferably be in the range of 1 to 10 wt %. In a case where the second coating layer is overlaid on the aforesaid coating layer of the first toner by fusion-bonding thereto the coating particles of the resin microparticles, a wax content of the overall coating layer(s) may preferably be in the range of 1 to 20 wt %. In a case where the coating layer containing the wax is formed over the core particles by making the wax microparticles to adhere to the core particle surface and then fusion-bonding thereto the coating particles of the resin microparticles, as suggested by the second toner, a wax content of the coating layer may preferably be in the range of 5 to 50 wt %.

If the aforesaid coating layer of the first or second toner contains the colorant in an insufficient amount, the image density cannot be fully increased. If, on the other hand, the colorant is present in an excessive amount, the toner is reduced in the chargeability. It is therefore preferred to use the colorant in an amount of 0.5 to 15 wt % based on the overall coating layer(s).

The following problems may be encountered in the formation of the aforesaid coating layer over the core particles of the first or second toner. If the amount of the coating layer based on the core particles is too small, the toner is prone to facture or aggregation, or cannot be increased in the chageability or stability to environment. If, on the other hand, the amount of the coating layer based on the core particles is too great, the productivity of the toner is lowered. It is therefore preferred to control the amount of the coating layer to 3 to 30 parts by weight based on 100 parts by weight of the core particles.

Examples of the resin used in the aforesaid core particles include: radical polymerizable resins such as (meth)acrylic ester resins and aromatic vinyl resins; condensation polymerizable resins such as polyester resins; and the like.

Examples of a radical polymerizable monomer used for forming the aforesaid radical polymerizable resin include: aromatic vinyl monomers, (meth)acrylic ester monomers, vinyl ester monomers, vinyl ether monomers, monoolefin monomers, diolefin monomers, halogenated olefin monomers and the like. In a case where the above core particles are formed by a granulation process in a wet system, it is preferred to use a radical polymerizable monomer having an acidic group such as to enhance the dispersion stability of the resin microparticles in the core particles.

Examples of a usable aromatic vinyl monomer include styrene monomers such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene and 3,4-dichlorostyrene; and the derivatives thereof.

Examples of the aforesaid (meth)acrylic ester monomer include methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate, diethylaminoethyl methacrylate and the like.

Examples of the aforesaid vinyl ester monomer include vinyl acetate, vinyl propionate, vinyl benzoate and the like.

Examples of the aforesaid vinyl ether monomer include vinyl methyl ether, vinyl ethyl ether, vinyl isobutyl ether, vinyl phenyl ether and the like.

Examples of the aforesaid monoolefin monomer include ethylene, propylene, isobutylene, 1-butane, 1-pentene, 4-methyl-1-pentene and the like.

Examples of the aforesaid diolefin monomer include butadiene, isoprene, chloroprene and the like.

Examples of the aforesaid halogenated olefin monomer include vinyl chloride, vinylidene chloride, vinyl bromide and the like.

Examples of the aforesaid radical polymerizable monomer having an acidic group include monomers containing a carboxylic group such as acrylic acid, methacrylic acid, fumaric acid, maleic acid, itaconic acid, cinnamic acid, monobutyl maleate and monooctyl maleate; monomers containing a sulfonic group such as styrene sulfonate, allyl sulfosuccinate and octyl allylsulfosuccinate; and the like. In the radical polymerizable monomer having the acidic group, the all or a part of the acidic group may be an alkali metal salt such as sodium and potassium, or an alkaline earth metal salt such as calcium.

For the purpose of improving the characteristics of the toner, such as anti-stress performance, a radically polymerizable crosslinking agent may also be added for copolymerization with the aforesaid radical polymerizable monomer. Examples of the radically polymerizable crosslinking agent include compounds having two or more unsaturated bonds, such as divinylbenzene, divinylnaphthalene, divinylether, diethylene glycol methacrylate, ethylene glycol dimethacrylate, polyethylene glycol dimethacrylate, and diallylphthalate.

The polyester resin as the aforesaid condensation polymerizable resin used in the core particles may include a polyester resin formed by polycondensation of a polyhydric alcohol component and a polyhydric carboxylic component.

Out of the above polyhydric alcohol component, a usable divalent alcohol component includes, for example, bisphenol-A alkylene oxide adducts such as polyoxypropylene(2,2)-2,2-bis(4-hydroxyphenyl)propane, polyoxypropylene(3,3)-2,2-bis(4-hydroxyphenyl)propane, polyoxypropylene(6)-2,2-bis(4-hydroxyphenyl)propane, and polyoxyethylene(2,0)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polytetramethylene glycol, bisphenol-A, hydrogenated bisphenol-A and the like. Examples of a usable alcohol component having a valence of more than 2 include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene and the like.

On the other hand, out of the aforesaid polyhydric carboxylic component, a divalent carboxylic component includes, for example, maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, isooctenylsuccinic acid, n-octylsuccinic acid, and isooctylsuccinic acid; and anhydrides thereof or lower alkyl esters thereof. Examples of a usable carboxylic component having a valence of more than 2 include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, 1, pyromellitic acid and Empol trimer acid; and anhydrides thereof or lower alkyl esters thereof.

Alternatively, there may also be used a resin formed as follows. A mixture of the aforesaid polyester resin monomer, the aforesaid vinyl resin monomer, and a monomer reactive with both the vinyl resin monomer and the polyester resin monomer is charged to a single vessel for concurrently carrying out a condensation polymerization reaction for forming the polyester resin and a radical polymerization reaction for forming the vinyl resin.

As the monomer reactive with both of the resin monomers, there may be used a monomer having both a condensation polymerizable carboxylic group and a radical polymerizable vinyl group. Examples of such a monomer include fumaric acid, maleic acid, acrylic acid, methacrylic acid and the like.

From the standpoint of enhancing the fixing performance of the toner, the aforesaid polyester resin may preferably have a number average molecular weight (Mn) of 1,000 to 10,000. For enhancing the sharp melt characteristic of the toner, the polyester resin may preferably have a value of weight average molecular weight (Mw)/number average molecular weight (Mn) in the range of 2.0 to 8.0. In the light of enhancing the low-temperature fixing performance of the toner, the polyester resin may preferably have a glass transition point (Tg) of 55 to 80° C., and a softening point (Tm) of 100 to 130° C.

Any of the known pigments commonly used in the prior art may be used as the colorant admixed in the aforesaid core particles. Examples of a usable pigment include carbon black, aniline blue, chalcoyl blue, chrome yellow, ultramarine blue, Du Pont oil red, quinoline yellow, methylene blue chloride, copper phthalocyanine, malachite green oxalate, lamp black, rose bengal, C.I. pigment red 48:1, C.I. pigment red 122, C.I. pigment red 57:1, C.I. pigment red 184, C.I. pigment yellow 97, C.I. pigment yellow 12, C.I. pigment yellow 17, C.I. solvent yellow 162, C.I. pigment yellow 180, C.I. pigment yellow 185, C.I. pigment blue 15:1, C.I. pigment blue 15:3 and the like.

In addition to the above colorant, a wax, a charge control agent, magnetic powder or the like may be admixed in the above core particles.

The wax may be any of the known waxes commonly used in the toner. Examples of a usable wax include: polyolefin waxes such as low-molecular-weight polyethylene wax and low-molecular-weight polypropylene wax; naturally occurring waxes such as carnauba wax and rice wax; montan wax; Fischer-Tropsh wax; paraffin waxes; and the like. Where the polyester resin is used as the aforementioned resin, it is preferred to use an oxidized wax from the standpoint of improving the dispersibility of the wax.

The charge control agent may be any of the known charge control agents used in the prior-art toner for controlling the chargeability thereof. Examples of a usable charge control agent include: metal-containing dyes such as fluorinated surfactants, metal complexes of salicylic acid and azo metal compounds; high-molecular acids of copolymers containing maleic acid as a monomer component; azine dyes such as quaternary ammonium salt and nigrosine; carbon black; and the like.

The above core particles may be formed by a milling process which include the steps of: heat melting and kneading a mixture containing the aforesaid resin, the aforesaid colorant and, as required, an additive such as the aforesaid wax and charge control agent; cooling the kneaded product; and milling the kneaded product. Otherwise, the core particles may be formed by a granulation process carried out in a wet system, which includes suspension polymerization process, emulsion dispersion process, emulsion polymerization/flocculation process, and the like. In order to prevent the toner from being degraded in chargeability due to water or dispersant remaining in the core particles, it is desirable to form the core particles by the aforementioned milling process.

In the production of the core particles using the aforesaid milling process, a resin, a colorant and, as required, an additive such as a wax and charge control agent are blended together by means of a mixing machine such as a Henschel mixer (commercially available from MITSUI MINING CO., LTD.). In this case, it is also possible to take a procedure including the steps of: preparing a master batch containing the resin and the colorant; adding the aforesaid additives, such as a wax and charge control agent, to the master batch; and homogeneously blending these materials.

The resultant mixture is molten and kneaded by means of a kneading machine such as a twin-screw extruder/kneader thereby dispersing the colorant, wax and such in the resin. The kneaded product is solidified by cooling.

Next, the kneaded product thus solidified is pulverized by means of a jet pulverizer 200 AFG (commercially available from Hosokawamicron Corporation). The pulverized product is classified by means of an air classifier 100ATP (commercially available from Hosokawamicron Corporation) thereby to obtain core particles having a predetermined particle size.

As the coating particles used for forming the coating layer over the above core particles, there may be used the aforesaid wax-containing resin microparticles containing at least a resin and a wax, the colorant-containing resin microparticles containing at least a resin and a colorant, the resin microparticles free from the wax or colorant, the wax microparticles, or the colorant microparticles. The above wax-containing resin microparticles may be further admixed with an additive such as a colorant, whereas the above colorant-containing resin microparticles may be further admixed with an additive such as a wax.

A resin for use in the above coating particles may be the same as that used for forming the core particles. Furthermore, a wax for use in the above wax-containing resin microparticles and a colorant for use in the above colorant-containing resin microparticles may be the same wax and colorant as those used for forming the above core particles.

The coating layer is formed by making such coating particles to adhere to the core particle surface and fusion-bonding thereto the coating particles. In the light of uniform adhesion of the coating particles to the core particle surface, such coating particles may preferably have a weight average particle size of 50 to 500 nm.

Similarly to the formation of the core particles, the coating particles of the aforesaid wax-containing resin microparticles or colorant-containing resin microparticles may be formed by a milling process or a granulation process in a wet system, such as suspension polymerization process, emulsion dispersion process and emulsion polymerization/flocculation process. It is particularly preferred to form the coating particles by the granulation process in the wet system which provides an easy control of the particle size and also accomplishes the incorporation of a sufficient amount of wax or colorant even into the above particles of small size.

In a case where the above wax-containing resin microparticles or colorant-containing resin microparticles are formed by the emulsion polymerization/flocculation process, the microparticles may be formed in a two-layered structure including the microparticles containing a wax or colorant, and a resin layer formed over the microparticles by emulsion polymerization. Alternatively, the microparticles may be formed in a three-layered structure including the resin microparticles, as cores, formed by emulsion polymerization, a layer containing a wax or colorant and formed over the resin microparticles, and a resin layer further overlaid on the above layer by emulsion polymerization. Where the wax-containing resin microparticles or the colorant-containing resin microparticles are produced in this manner, the resultant microparticles not only have a narrow particle size distribution but also contain the wax or colorant in a greater amount.

In a case where the above wax-containing resin microparticles or colorant-containing resin microparticles are formed by the emulsion dispersion process, the following procedure may be taken, for example. A resin and a wax or colorant are dissolved in a solvent. The resultant solution is emulsified and dispersed in a water-based medium. Subsequently, the solvent is removed from the dispersed particles.

Alternatively, the above wax-containing resin microparticles or colorant-containing resin microparticles may also be formed as follows. Along with a wax or a colorant, a resin having a hydrophilic group such as hydroxyl group or carboxyl group are emulsified and dispersed in a water-based medium so as to form particles.

On the other hand, the coating particles of the wax microparticles or colorant microparticles for use in the second toner may be formed as follows. A bead mill, colloid mill, emulsion disperser or the like is used to apply a high shearing force to the aforesaid wax or colorant in a water-based medium so as to disperse the wax or colorant in the medium.

The first toner mentioned above may be produced as follows, for example. The aforesaid coating particles of the wax-containing resin microparticles or colorant-containing resin microparticles are uniformly fixed to the surface of the above core particles in a dry system by applying thereto a mechanical impact or by a dry mechanochemical process. Subsequently, heat treatment is performed to fusion-bond the attached coating particles to the core particle surface, thereby forming the coating layer.

In the first toner, the second coating layer may be overlaid on the above coating layer as follows, for example. The coating particles of the resin microparticles are uniformly fixed to the surface of the above coating layer in a dry system by applying thereto a mechanical impact or by a dry mechanochemical process. Subsequently, heat treatment is performed to fusion-bond the attached coating particles to the coating layer, thereby forming the second coating layer.

The aforesaid second toner may be produced as follows, for example. The coating particles of the aforesaid wax microparticles or colorant microparticles are uniformly fixed to the surface of the aforesaid core particles in a dry system by applying thereto a mechanical impact or by a dry mechanochemical process. Furthermore, the coating particles of the resin microparticles are uniformly fixed to the attached coating particles in a dry system by applying thereto a mechanical impact or by a dry mechanochemical process. Subsequently, heat treatment is performed to fusion-bond these coating particles to the core particles thereby forming the coating layer.

Where the coating particles are fixed by applying thereto the mechanical impact, as described above, there may be used, for example, Hybridizer NHS-1 (commercially available from Nara Machinery Co., Ltd.), Cosmo System (commercially available from Kawasaki Heavy Industries Ltd.) or the like.

Where the coating particles are fixed by the dry mechanochemical process, as described above, there may be used, for example, Mechanofusion System (commercially available from Hosokawamicron Corporation), Mechanomill (commercially available from Okadaseiko Co., Ltd.) or the like.

When the coating particles are fusion-bonded by heat treatment thereby to form the coating layer, as described above, there may be used, for example, Surfusing System SF-3 (commercially available from Japan Pneumatic Mfg. Co., Ltd.) or the like. When the coating layer is formed by fusion-bonding the coating particles, it is preferred to sphere toner particles by heat treatment thereby controlling the roundness thereof to 0.93 to 0.99.

Each of the toners of the above embodiments may be admixed with an external additive. As such an external additive, there may be used, for example, the known inorganic microparticles used for adjusting the fluidity of the toner.

Examples of such inorganic microparticles include: a variety of carbides such as silicon carbide, boron carbide, titanium carbide, zirconium carbide, hafnium carbide, vanadium carbide, tantalum carbide, niobium carbide, tungsten carbide, chromium carbide, molybdenum carbide, calcium carbide, and diamond carbon lactam; a variety of nitrides such as boron nitride, titanium nitride and zirconium nitride; a variety of borides such as zirconium boride; a variety of oxides such as titanium oxide, calcium oxide, magnesium oxide, zinc oxide, copper oxide, aluminum oxide, silica and colloidal silica; a variety of titanate compounds such as calcium titanate, magnesium titanate and strontium titanate; sulfides such as molybdenum disulfide; a variety of fluorides such as magnesium fluoride and carbon fluoride; a variety of metal soaps such as aluminum stearate, calcium stearate, zinc stearate and magnesium stearate; and a variety of non-magnetic inorganic microparticles such as talc and bentonite. These microparticles may be used alone or in combination of plural types.

For the purpose of controlling the adhesion of a post-treatment agent, it is preferred that the aforesaid microparticles of silica, titanium oxide, alumina, zinc oxide or the like is surface treated with a hydrophobic treating agent conventionally used in the art, such as silane coupling agent, titanate coupling agent, silicone oil or silicone varnish; fluorinated silane coupling agent or fluorinated silicone oil; a coupling agent having an amino group or a quaternary ammonium salt; modified silicone oil; or the like.

The aforesaid inorganic microparticles may have an average primary particle size of 5 to 100 nm, preferably of 10 to 50 nm, or more preferably of 20 to 40 nm. This is because the use of the inorganic microparticles having such a particle size provides for an effective control of the adhesion stress of the toner.

Assume that the amount of inorganic microparticles added to the toner is represented by G (wt %) and that the volume average particle size of the above toner particles is represented by D50 (μm), the value of D50×G may be adjusted to the range of 4 to 14, preferably of 5 to 13.5, or more preferably of 6 to 13, such as to enhance the effects of the toner fluidity and the like.

Besides the aforementioned inorganic microparticles, organic microparticles may also be externally added.

Such organic microparticles may be formed from styrene, (meth)acryl, benzoguanamine, melamine, tetrafluoroethylene, silicone, polyethylene, polypropylene or the like by a wet polymerization process such as emulsion polymerization process, soap-free emulsion polymerization process and non-aqueous dispersion polymerization process; a vapor phase process; or the like. The resultant microparticles may be added as a cleaning assistant or the like.

The toners according to the above embodiments may be used as a color toner of each color for use in full-color image forming apparatuses and also as a monochromatic toner for use in monochromatic image forming apparatuses.

The toner according to each of the embodiments provides an adequate transfer performance while retaining good chargeability and stability to environment. Where the toner of the embodiment is used as a color toner of each color in the full-color image forming apparatus, therefore, the formed images are prevented from suffering white spots.

Furthermore, the toner of the invention may be used in image forming apparatuses having any type of fixing device because the toner provides an adequate transfer performance while retaining the good chargeability and stability to environment, as described above. In an image forming apparatus employing a fixing device with a reduced amount of mold release oil applied to a fixing member such as a roller or the fixing device with the mold release oil applied thereto in an amount of not more than 4 mg/m$^2$, or in an image forming apparatus employing a fixing device dispensing with the application of the mold release oil, for example, the toner of the invention may be used to form images effectively reduced in the white spots.

The toner of the invention may be used as a one-component developer free from a carrier and also as a two-component developer comprising a combination of the toner and the carrier.

Next, specific description will be made on toners according to the examples of the invention and the production processes for the same. In addition, the superiority of the toners according to the examples of the invention will be demonstrated with reference to comparative examples.

For preparation of toners of Examples 1 to 10 and of Comparative Examples 1 to 3, coating particles A1 to A7 were formed as follows.

Preparation of Coating Particles A1

A reaction flask equipped with a stirrer, a heating/cooling element, a condenser and a stock/assistant feeder was charged with a solution of 2.0 parts by weight of sodium dodecylsulfonate dissolved in 700 parts by weight of ion-exchanged water. The solution was heated to 80° C. with stirring at 200 rpm under a nitrogen flow.

The solution was admixed with a solution of 5 parts by weight of potassium persulfate dissolved in 40 parts by weight of ion-exchanged water and heated to 75° C. Subsequently, a monomer solution mixture containing 64.0 parts by weight of styrene, 32.5 parts by weight of n-butyl acrylate, 3.5 parts by weight of methacrylic acid and 1.0 part by weight of n-octylmercaptan was added dropwise over the course of 30 minutes. The resultant mixture was reacted at 75° C. to form a first latex.

Another reaction flask was charged with a monomer solution mixture containing 60.0 parts by weight of styrene, 36.5 pars by weight of n-butyl acrylate, 3.5 parts by weight of methacrylic acid and 1.0 part by weight of n-octylmercaptan, and also with 14.0 parts by weight of polyester wax (WEP-5 commercially available from NOF Corporation). The resultant mixture was heated to 85° C. thereby to form a monomer solution mixture with the wax dissolved therein.

Still another reaction flask was charged with a solution of 0.3 parts by weight of sodium dodecylsulfonate dissolved in 540 parts by weight of ion-exchanged water and heated to 80° C. The solution was admixed with 5.6 parts by weight of the above first latex on a solid basis, and then with the above monomer solution mixture with the wax dissolved therein. The resultant mixture was mixingly dispersed by a homogenizer (TK Homomixer commercially available from Tokusyu Kika Kogyo Co., Ltd.) thereby to form an emulsion.

Next, the resultant emulsion was admixed with a solution of 1 part by weight of potassium persulfate dissolved in 50 parts by weight of ion-exchanged water, and with 150 parts by weight of ion-exchanged water. The resultant mixture was heated to 80° C. and polymerized for 3 hours, thereby to form a second latex containing the wax.

The second latex was admixed with a solution of 1.5 parts by weight of potassium persulfate dissolved in 40 parts by weight of ion-exchanged water and heated to 80° C. Subsequently, a monomer solution mixture containing 60.0 parts by weight of styrene, 19.0 parts by weight of n-butyl acrylate, 3.0 parts by weight of methacrylic acid and 2.1 parts by weight of n-octylmercaptan was added dropwise over the course of 30 minutes. The resultant mixture was polymerized at 80° C. for 2 hours and then, cooled to 30° C., thereby to form a third latex containing the wax.

Next, the third latex was washed with water and then, spray dried to form coating particles A1 consisting of resin microparticles containing the wax. The coating particles A1 had a wax content of 6.9 wt % and a number average particle size of 230 nm. The number average particle size was determined using Super-dynamic Light Scattering Spectrophotometer (ELS-800 commercially available from OTSUKA ELECTRONICS CO., LTD.).

Preparation of Coating Particles A2

A latex of styrene-acryl copolymer containing styrene and butyl acrylate monomers in a weight ratio of 50:50 was prepared by a soap-free emulsion polymerization process. The resultant latex was washed with water and then spray dried to form coating particles A2 consisting of resin microparticles. The coating particles A2 had a glass transition point Tg of 63° C., a softening point Tm of 135° C. and a number average particle size of 200 nm determined in the aforementioned manner.

The glass transition point Tg was determined by using a differential scanning calorimeter (DSC-200 commercially available from Seiko Instruments Inc.) as follows. A 10 mg measurement sample was accurately weighed out and charged to an aluminum pan. On the other hand, alumina was charged to an aluminum pan as a reference. The sample at normal temperatures was heated to 200° C. at a heating rate of 30° C./min and then cooled. Measurement was taken in the temperature range of 20 to 120° C. while heating at a rate of 10° C./min. In an endothermic curve in a temperature range of 30 to 90° C. of the heating process, a shoulder of a main endothermic peak was determined as the glass transition point Tg.

The softening point Tm was determined by using a flow tester (CFT-500 commercially available from SHIMADZU CORPORATION) as follows. A 1.0 g measurement sample was accurately weighed out and set in a die having a diameter of 1.0 mm and a length of 1.0 mm. The measurement was taken under the conditions of: a heating rate of 30° C./min, a preheat time of 180 seconds, a load of 30 kg and a measurement temperature range of 60 to 180° C. A temperature at which a half of the above sample flowed out of the die was determined as the softening point Tm.

Preparation of Coating Particles A3

10 parts by weight of self-dispersing polyester resin on a solid basis (Vylonal MD-1245 commercially available from TOYOBO CO., LTD.) was dispersed in water heated to 90° C., the resin having a glass transition point Tg of 61° C. The resultant dispersion was admixed with 5 parts by weight of C.I. Direct Blue 199 as a colorant for dyeing the resin particles. The dyed particles were washed with water and then spray dried. Thus were obtained coating particles A3 of the resin microparticles dyed blue. The coating particles A3 had a number average particle size of 185 nm and a colorant content of 10 wt % as determined from difference between the weights thereof before and after the dyeing process.

Preparation of Coating Particles A4

There was prepared a blend containing 680 parts by weight of distilled water, 180 parts by weight of ethylene homopolymer having a softening point Tm of 107° C. (Polywax 850 commercially available from TOYO-PETRO- LITE CO., LTD.) and 17 parts by weight of sodium dodecylbenzenesulfonate (NEOGEN SC commercially available from DAIICHI-KOGYO CO., LTD.). The resultant mixture was emulsified and dispersed under high shearing force by means of an emulsifier/disperser (CLEAR MIX commercially available from M TECHNIQUE CO., LTD.). Thus was obtained a dispersion of wax microparticles.

The resultant wax microparticles were washed with water and freeze dried. Then, the dried product was milled to form coating particles A4 of the wax microparticles. The coating particles A4 had a number average particle size of 110 nm.

Preparation of Coating Particles A5

A cyan colorant, C.I. Pigment Blue 15-3 (commercially available from Toyo Ink Mfg. Co., Ltd.) was dispersed in distilled water by means of a bead mill thereby to obtain a dispersion of colorant microparticles having a solid content of 17 wt %.

The dispersion of colorant microparticles was spray dried and the dried microparticles were milled to obtain coating particles A5 of the colorant microparticles. The coating particles A5 had a number average particle size of 103 nm.

Preparation of Coating Particles A6

In the preparation of coating particles A6, the first latex was prepared the same way as in the preparation of the above coating particles A1.

Another reaction flask was charged with a monomer solution mixture containing 60.0 parts by weight of styrene, 36.5 parts by weight of n-butyl acrylate, 3.5 parts by weight of methacrylic acid and 1.0 part by weight of n-octylmercaptan. Then, 10.0 parts by weight of polyester wax (WEP-5 commercially available from NOF Corporation) was further added. The resultant solution mixture was heated to 85° C. to form a monomer solution mixture with the wax dissolved therein.

Still another reaction flask was charged with a solution of 0.3 parts by weight of sodium dodecylsulfonate dissolved in 540 parts by weight of ion-exchanged water. After heated to 80° C., the solution was further admixed with 5.6 parts by weight of the above first latex on a solid basis, 4 parts by weight of C.I. Pigment Blue 15-3 (commercially available from Toyo Ink Mfg. Co., Ltd.) as a colorant, and the above monomer solution mixture with the wax dissolved therein. The resultant mixture was mixingly dispersed by the homogenizer (TK Homomixer commercially available from Tokusyu Kika Kogyo Co., Ltd.) thereby to form an emulsion.

Next, the emulsion was admixed with a solution of 1 part by weight of potassium persulfate dissolved in 50 parts by weight of ion-exchanged water, and with 150 parts by weight of ion-exchanged water. The resultant mixture was heated to 80° C. and polymerized for 3 hours thereby to form a second latex containing the wax and the colorant.

Subsequently, the same procedure as in the preparation of the coating particles A1 was taken to form the coating particles A1 of the resin microparticles containing the wax and the colorant. The coating particles A6 had a wax content of 5.0 wt %, a colorant content of 2.0 wt %, and a number average particle size of 210 nm.

Preparation of Coating Particles A7

In the preparation of coating particles A7, the first latex was formed the same way as in the preparation of the coating particles A1.

Another reaction flask was charged with a monomer solution mixture containing 60.0 parts by weight of styrene, 36.5 parts by weight of n-butyl acrylate, 3.5 parts by weight of methacrylic acid and 1.0 part by weight of n-octylmercaptan. Then, 25.0 parts by weight of polyester wax (WEP-5 commercially available from NOF Corporation) was further added. The resultant solution mixture was heated to 85° C. to form a monomer solution mixture with the wax dissolved therein.

Still another reaction flask was charged with a solution of 0.3 parts by weight of sodium dodecylsulfonate dissolved in 540 parts by weight of ion-exchanged water. After heated to 80° C., the solution was further admixed with 5.6 parts by weight of the above first latex on a solid basis, 37.5 parts by weight of C.I. Pigment Blue 15-3 (commercially available from Toyo Ink Mfg. Co., Ltd.) as a colorant, and the above monomer solution mixture with the wax dissolved therein. The resultant mixture was mixingly dispersed by the homogenizer (TK Homomixer commercially available from Tokusyu Kika Kogyo Co., Ltd.) thereby to form an emulsion.

Next, the emulsion was admixed with a solution of 1 part by weight of potassium persulfate dissolved in 50 parts by weight of ion-exchanged water, and with 150 parts by weight of ion-exchanged water. The resultant mixture was heated to 80° C. and polymerized for 3 hours thereby to form a second latex containing the wax and the colorant.

Subsequently, the same procedure as in the preparation of the coating particles A1 was taken to form the coating particles A7 of the resin microparticles containing the wax and the colorant. The coating particles A7 had a wax content of 10 wt %, a colorant content of 15 wt %, and a number average particle size of 180 nm.

As to the coating particles A1 to A7 prepared in the aforementioned manners, weight percentages of the resin, the wax and the colorant are listed in Table 1 as below.

TABLE 1

| COATING PARTICLES | RESIN (wt %) | WAX (wt %) | COLORANT (wt %) |
|---|---|---|---|
| A1 | 93.1 | 6.9 | — |
| A2 | 100 | — | — |
| A3 | 90 | — | 10 |
| A4 | — | 100 | — |
| A5 | — | — | 100 |
| A6 | 93.1 | 5.0 | 2.0 |
| A7 | 75 | 10 | 15 |

EXAMPLE 1

In Example 1, a polyester resin was prepared as follows. Polyoxypropylene(2,2)-2,2-bis(4-hydroxyphenyl)propane, polyoxyethylene(2,0)-2,2-bis(4-hydroxyphenyl)propane, and terephthalic acid were blended in a molar ratio of 3:7:9. The resultant mixture together with dibutyltin oxide as a polymerization initiator were charged to a 4-necked glass flask equipped with a thermometer, a stainless-steel stirring rod, a falling-type condenser and a nitrogen inlet tube. The mixture was polymerized to form a polyester resin, which had a number average molecular weight (Mn) of 3300, a ratio between weight average molecular weight (Mw) and number average molecular weight (Mn) of 4.2, a glass transition point Tg of 68.5° C. and a softening point Tm of 110.3° C.

The average molecular weight was determined using gel permeation chromatography (807-IT model commercially available from NIHON BUNKO KOGYOSYA) as follows. With column temperature maintained at 40° C., tetrahydrofuran as a carrier solvent was flowed through the column under a pressure of 1 kg/cm$^2$. A solution was prepared by dissolving 30 mg of measurement sample in 20 ml of tetrahydrofuran. Then, 0.5 mg of the resultant solution along with the carrier solvent were introduced into the above apparatus to determine the average molecular weight based on polystyrene standard.

The polyester resin formed in the aforementioned manner was roughly milled into particles of a size not more than 1 mm.

Next, the polyester resin particles and a cyan colorant of C.I. Pigment Blue 15-3 (commercially available from Toyo Ink Mfg. Co., Ltd.) in a weight ratio of 7:3 were charged to a pressure kneader so as to be kneaded at 120° C. for 2 hours. The kneaded product was cooled and roughly milled by a hammer mill. Thus was obtained a pigment master batch having a cyan-pigment content of 30 wt %.

Next, the above polyester resin particles, the above pigment master batch and polyester wax (WEP-5 commercially available from NOF Corporation) were fully blended together by a Henschel mixer which was operated at a circumferential speed of 40 m/sec for 180 seconds. The above blend of the polyester resin particles, pigment master batch and polyester wax was prepared using 7 parts by weight of cyan pigment of C.I. Pigment Blue 15-3 and 1 part by weight of polyester wax based on 100 parts by weight of the polyester resin.

The above blend was molten and kneaded by a twin-screw extruder/kneader (PCM-30 commercially available from Ikegai Tekko Co., Ltd.). The kneaded product was pressure spread to a thickness of 2 mm by means of a press roller, cooled on a cooling belt and then, roughly milled by a feather mill. The resultant particles were pulverized by a mechanical pulverizer (KTM commercially available from Kawasaki Heavy Industries Ltd.) and then, finely pulverized by a jet pulverizer (IDS commercially available from Japan Pneumatic Mfg. Co., Ltd.). The resultant particles were classified by a rotor-type classifier (T-Plex Classifier 100ATP commercially available from Hosokawamicron Corporation). Thus were obtained core particles having a volume average particle size of 6.5 μm. The volume average particle size was determined using Coulter Multi-sizer II (commercially available from Coulter Electronics Ltd.) and an aperture tube of 50 μm.

Next, 5 parts by weight of the coating particles A1 of the aforesaid wax-containing resin microparticles and 100 parts by weight of the core particles were blended together by means of Hybridizer NHS-1 (commercially available from Nara Machinery Co., Ltd.) which was operated at a rotor speed of 90 m/s for 5 minutes. Thus, the coating particles A1 were made to adhere to the surface of the core particles.

Subsequently, the core particles with the coating particles A1 attached thereto were hot-air treated by a hot-air sphering machine (SURFUSING SYSTEM SFS-3 commercially available from Japan Pneumatic Mfg. Co., Ltd.), which was operated under the conditions of an inlet temperature of 300° C. and a hot-air contact time of 0.01 second. Thus, the coating particles A1 were fusion-bonded to the surface of the core particles in the dry system, so that a first coating layer containing the wax was formed over the core particles. The core particles coated with the first coating layer had a volume average particle size of 6.1 μm and an average roundness of 0.94.

The average roundness was determined as follows. Measurement was taken on the particles by means of a flow particle image analyzer (FPIA-2000 commercially available from SYSMEX CORPORATION) and the roundness was calculated based on the following equation:

Average Roundness=Circumferential length of a circle having an equal area to that of particle projection image/Circumferential length of particle projection image.

In addition, 6 parts by weight of the coating particles A2 of the resin microparticles (6.3 parts by weight based on 100 parts by weight of core particles alone) were added to 100 parts by weight of the core particles coated with the first coating layer. In a similar manner to the fixation of the coating particles A1, the coating particles A2 were fusion-bonded onto the aforesaid first coating layer so as to form a second coating layer. Thus were obtained toner particles including the core particles coated with the first and second coating layers. The toner particles had a volume average particle size of 6.3 μm and an average roundness of 0.96.

Then, external additives including 0.5 parts by weight of hydrophobic silica (H-2000 commercially available from Clariant Inc.), 1.0 part by weight of titanium oxide (STT30A commercially available from Titan Kogyo Kabushiki Kaisha) and 1.0 part by weight of strontium titanate having a volume average particle size of 0.2 μm were added to 100 parts by weight of the above toner particles. The mixture was blended together by means of a Henschel mixer which was operated at a circumferential speed of 40 m/sec for 60 seconds. Thereafter, the resultant mixture was filtered through a 90 μm filter to obtain a toner of Example 1.

EXAMPLE 2

In Example 2, 5 parts by weight of the coating particles A3 of the colorant-containing resin microparticles were added to 100 parts by weight of the core particles formed the same way as in Example 1. In the dry system, the coating particles A3 were fusion-bonded to the surface of the above core particles the same way as in Example 1, thereby forming a first coating layer containing the colorant. Thus were obtained toner particles including the core particles coated with only the first coating layer. The toner particles had a volume average particle size of 6.1 μm and an average roundness of 0.97.

The toner particles were admixed with the external additives the same way as in Example 1 thereby to form a toner of Example 2.

EXAMPLE 3

In Example 3, 5 parts by weight of the coating particles A4 of the wax microparticles were added to 100 parts by weight of the core particles formed the same way as in Example 1. In the dry system, the coating particles A4 were fusion-bonded to the surface of the above core particles the same way as in Example 1.

Next, 6 parts by weight of the coating particles A2 of the resin microparticles (6.3 parts by weight based on 100 parts by weight of the core particles alone) were added to 100 parts by weight of the core particles with the coating particles A4 of the wax microparticles fusion-bonded thereto. In a similar manner to the formation of the second coating layer in Example 1, the coating particles A2 were fusion-bonded in the dry system to the surface of the core particles with the coating particles A4 attached thereto, thereby to form thereover a first coating layer containing the wax. Thus were obtained toner particles including the core particles coated with only the first coating layer. The toner particles had a volume average particle size of 6.3 μm and an average roundness of 0.98.

Subsequently, the toner particles were admixed with the external additives the same way as in Example 1 thereby to form a toner of Example 3.

EXAMPLE 4

In Example 4, 1 part by weight of the coating particles A5 of the colorant microparticles were added to 100 parts by weight of the core particles formed the same way as in Example 1. These particles were treated by Mechanomill (commercially available from Okadaseiko Co., Ltd.) which was operated at 2000 rpm for 30 minutes for embedding the coating particles A5 in the surface of the core particles in a dry system.

Next, 8 parts by weight of the coating particles A2 of the resin microparticles (8.1 parts by weight based on 100 parts by weight of the core particles alone) were added to 100 parts by weight of the core particles with the coating particles A5 attached thereto. Similarly to Example 1, the coating particles A2 were fusion-bonded, in the dry system, to the surface of the core particles with the coating particles A5 attached thereto, thereby forming thereover a first coating layer containing the colorant. Thus were obtained toner particles including the core particles coated with only the first coating layer. The toner particles had a volume average particle size of 6.3 μm and an average roundness of 0.96.

Subsequently, the toner particles were admixed with the external additives the same way as in Example 1 thereby to form a toner of Example 4.

EXAMPLE 5

In Example 5, 1 part by weight of the coating particles A4 of the wax microparticles and 1 part by weight of the coating particles A5 of the colorant microparticles were added to 100 parts by weight of the core particles formed the same way as in Example 1. Similarly to Example 4, these particles were treated by Mechanomill for embedding the coating particles A4 and A5 in the surface of the core particles in the dry system.

Next, 8 parts by weight of the coating particles A2 of the resin microparticles (8.2 parts by weight based on 100 parts by weight of the core particles alone) were added to 100 parts by weight of the core particles with the coating particles A4 and A5 attached thereto. Similarly to Example 1, the coating particles A2 were fusion-bonded in the dry system to the surface of the core particles with the coating particles A4 and A5 attached thereto, thereby forming thereover a first coating layer containing the wax and the colorant. Thus were obtained toner particles including the core particles coated with only the first coating layer. The toner particles had a volume average particle size of 6.3 μm and an average roundness of 0.97.

Subsequently, the toner particles were admixed with the external additives the same way as in Example 1 thereby to form a toner of Example 5.

EXAMPLE 6

In Example 6, 5 parts by weight of the coating particles A6 of the resin microparticles containing the wax and colorant were added to 100 parts by weight of the core particles formed the same way as in Example 1. Similarly to Example 1, the coating particles A6 were fusion-bonded to the surface of the core particles in the dry system, thereby forming thereover a first coating layer containing the wax and the colorant.

Next, 6.3 parts by weight of the coating particles A2 of the resin microparticles were added to 100 parts by weight of the core particles formed with the first coating layer. Similarly to Example 1, the coating particles A2 were fusion-bonded to the surface of the first coating layer in the dry system, thereby forming thereover a second coating layer. Thus were obtained toner particles including the core particles coated with the first and second coating layers. The toner particles had a volume average particle size of 6.2 μm and an average roundness of 0.96.

Subsequently, the toner particles were admixed with the external additives the same way as in Example 1 thereby to form a toner of Example 6.

EXAMPLE 7

In Example 7, 8 parts by weight of the coating particles A1 of the wax-containing resin microparticles were added to 100 parts by weight of the core particles formed the same way as in Example 1. Similarly to Example 1, the coating particles A1 were fusion-bonded to the surface of the core particles in the dry system, thereby forming thereover a first coating layer containing the wax. Thus were obtained toner particles including the core particles coated with only the first coating layer. The toner particles had a volume average particle size of 6.2 μm and an average roundness of 0.97.

Subsequently, the toner particles were admixed with the external additives the same way as in Example 1 thereby to form a toner of Example 7.

EXAMPLE 8

In Example 8, 20 parts by weight of the coating particles A6 of the resin microparticles containing the wax and the colorant were added to 100 parts by weight of the core particles formed the same way as in Example 1. Similarly to Example 1, the coating particles A6 were fusion-bonded to the surface of the core particles in the dry system, thereby forming thereover a first coating layer containing the wax and the colorant. Thus were obtained toner particles including the core particles coated with only the first coating layer. The toner particles had a volume average particle size of 6.3 μm and an average roundness of 0.96.

Subsequently, the toner particles were admixed with the external additives the same way as in Example 1 thereby to form a toner of Example 8.

EXAMPLE 9

In Example 9, 18 parts by weight of the coating particles A3 of the colorant-containing resin microparticles were added to 100 parts by weight of the core particles formed the same way as in Example 1. Similarly to Example 1, the coating particles A3 were fusion-bonded to the surface of the core particles in the dry system, thereby forming thereover a first coating layer containing the colorant.

Next, 5.08 parts by weight of the coating particles A2 of the resin microparticles (6 parts by weight based on 100 parts by weight of the core particles alone) were added to 100 parts by weight of the core particles formed with the first coating layer. Similarly to Example 1, the coating particles A2 were fusion-bonded to the surface of the first coating layer in the dry system, thereby forming thereover a second coating layer. Thus were obtained toner particles including the core particles coated with the first and second coating layers. The toner particles had a volume average particle size of 6.4 μm and an average roundness of 0.97.

Subsequently, the toner particles were admixed with the external additives the same way as in Example 1 thereby to form a toner of Example 9.

EXAMPLE 10

In Example 10, 20 parts by weight of the coating particles A7 containing the wax and the colorant were added to 100 parts by weight of the core particles formed the same way as in Example 1. Similarly to Example 1, the coating particles A7 were fusion-bonded to the surface of the core particles in the dry system, thereby forming thereover a first coating layer containing the wax and the colorant.

Next, 4.17 parts by weight of the coating particles A2 of the resin microparticles (5 parts by weight based on 100 parts by weight of the core particles alone) were added to 100 parts by weight of the core particles formed with the first coating layer. Similarly to Example 1, the coating particles A2 were fusion-bonded to the surface of the first coating layer in the dry system. Thus were obtained toner particles having a second coating layer of the resin overlaid on the first coating layer. The toner particles had a volume average particle size of 6.4 m and an average roundness of 0.97.

Subsequently, the toner particles were admixed with the external additives the same way as in Example 1 thereby to form a toner of Example 10.

COMPARATIVE EXAMPLE 1

Comparative Example 1 used the core particles formed the same way as in Example 1 as toner particles, dispensing with the coating layer to be overlaid on the core particles. The toner particles had a volume average particle size of 6.3 μm and an average roundness of 0.92.

Subsequently, the toner particles were admixed with the external additives the same way as in Example 1 thereby to form a toner of Comparative Example 1.

COMPARATIVE EXAMPLE 2

In Comparative Example 2, 10 parts by weight of the coating particles A2 of the resin microparticles were added to 100 parts by weight of the core particles formed the same way as in Example 1. Similarly to Example 1, the coating particles A2 were fusion-bonded to the surface of the core particles in the dry system. Thus were obtained toner particles including the core particles coated with the first coating layer consisting of the resin. The toner particles had a volume average particle size of 6.3 μm and an average roundness of 0.97.

Subsequently, the toner particles were admixed with the external additives the same way as in Example 1 thereby to form a toner of Comparative Example 2.

COMPARATIVE EXAMPLE 3

In Comparative Example 3, a reaction vessel equipped with a stirrer, a cooling tube and a temperature sensor was charged with 100 parts by weight of the core particles formed the same way as in Example 1, 1 part by weight of sodium dodecylsulfate and 480 parts by weight of distilled water, which were stirred to disperse the core particles.

The resultant core-particle dispersion was admixed with 5 parts by weight of dispersion of the coating particles A1 on a solid basis, the coating particles consisting of the wax-containing resin microparticles. The mixture was heated to 70° C. with stirring. Then, 40 parts by weight of aqueous solution of 50wt % magnesium chloride was added to the mixture, which was retained at 70° C. for 20 minutes.

Next, 6.3 parts by weight of dispersion of the coating particles A2 of the resin microparticles on a solid basis were added to the resultant dispersion mixture, which was heated to 75° C. Thereafter, 40 parts by weight of aqueous solution of 50wt % magnesium chloride was added to the dispersion mixture, which was retained at 75° C. for 1.5 hours.

Subsequently, 120 parts by weight of aqueous solution of 20 wt % sodium chloride were added to the dispersion mixture, which was heated to 92° C. and retained for 1 hour. The dispersion mixture was cooled to room temperatures and particles were filtered out. The resultant particles were washed with distilled water several times and then dried. Thus were obtained toner particles coated with the same first and second coating layers as those of Example 1, the first and second coating layers formed in a wet system. The toner particles had a volume average particle size of 6.2 μm and an average roundness of 0.97.

Subsequently, the toner particles were admixed with the external additives the same way as in Example 1 thereby to form a toner of Comparative Example 3.

As to each of the toners of Examples 1 to 10 and of Comparative Examples 1 to 3, the following items are listed in Table 2 as below. The items include the type of coating particles used in each coating layer and the proportion thereof×(parts by weight) based on 100 parts by weight of the core particles; the wax content Wa (wt %) based on the overall coating layer(s); the colorant content Wb (wt %) based on the overall coating layer(s); the proportion of the overall coating layer(s) Xt (parts by weight) based on 100 parts by weight of the core particles; and the conditions of forming the coating layer.

TABLE 2

| | CORE PARTICLES (BASED ON 100 PARTS BY WEIGHT OF RESIN | | FIRST COATING LAYER | | SECOND COATING LAYER | | | | | CONDITIONS OF FORMING COATING LAYER |
|---|---|---|---|---|---|---|---|---|---|---|
| | WAX IN PART BY WEIGHT | COLORANT IN PART BY WEIGHT | COATING PARTICLES | X (PART BY WEIGHT) | COATING PARTICLES | X (PART BY WEIGHT) | Wa (PART BY WEIGHT) | Wb (PART BY WEIGHT) | Xt (PART BY WEIGHT) | |
| EXAMPLE 1 | 1 | 7 | A1 | 5 | A2 | 6.3 | 3.1 | — | 11.3 | DRY SYSTEM |

TABLE 2-continued

| | CORE PARTICLES (BASED ON 100 PARTS BY WEIGHT OF RESIN | | FIRST COATING LAYER | | SECOND COATING LAYER | | | | | CONDITIONS OF |
|---|---|---|---|---|---|---|---|---|---|---|
| | WAX IN PART BY WEIGHT | COLORANT IN PART BY WEIGHT | COATING PARTICLES | X (PART BY WEIGHT) | COATING PARTICLES | X (PART BY WEIGHT) | Wa (PART BY WEIGHT) | Wb (PART BY WEIGHT) | Xt (PART BY WEIGHT) | FORMING COATING LAYER |
| EXAMPLE 2 | 1 | 7 | A3 | 5 | — | — | — | 10 | 5 | DRY SYSTEM |
| EXAMPLE 3 | 1 | 7 | A4 + A2 | 5 + 6.3 | — | — | 44.2 | — | 11.3 | DRY SYSTEM |
| EXAMPLE 4 | 1 | 7 | A5 + A2 | 1 + 8.1 | — | — | — | 11 | 9.1 | DRY SYSTEM |
| EXAMPLE 5 | 1 | 7 | A4 + A5 + A2 | 1 + 1 + 8.2 | — | — | 9.8 | 9.8 | 10.2 | DRY SYSTEM |
| EXAMPLE 6 | 1 | 7 | A6 | 5 | A2 | 6.3 | 2.2 | 0.9 | 11.3 | DRY SYSTEM |
| EXAMPLE 7 | 1 | 7 | A1 | 8 | — | — | 7 | — | 8 | DRY SYSTEM |
| EXAMPLE 8 | 1 | 7 | A6 | 20 | — | — | 5 | 2 | 20 | DRY SYSTEM |
| EXAMPLE 9 | 1 | 7 | A3 | 18 | A2 | 6 | — | 7.5 | 24 | DRY SYSTEM |
| EXAMPLE 10 | 1 | 7 | A7 | 20 | A2 | 5 | 8 | 12 | 25 | DRY SYSTEM |
| COMPARATIVE EXAMPLE 1 | 1 | 7 | — | — | — | — | — | — | — | — |
| COMPARATIVE EXAMPLE 2 | 1 | 7 | A2 | 10 | — | — | — | — | 10 | DRY SYSTEM |
| COMPARATIVE EXAMPLE 3 | 1 | 7 | A1 | 5 | A2 | 6.3 | 3.1 | — | 11.3 | WET SYSTEM |

Next, the toners of Examples 1 to 10 and of Comparative Examples 1 to 3 produced in the aforementioned manners were evaluated for thermostability. The results are listed in Table 3 as below. The thermostability was examined as follows. A 10 g sample of each of the toners was allowed to stand under a high temperature of 50° C. for 24 hours and thereafter, visually observed. The thermostability of the individual toners was evaluated based on the following criteria: ○ represents a toner absolutely free from toner aggregation; Δ represents a toner containing less than 10 aggregated pieces; and × represents a toner containing more than 10 aggregated pieces.

Each of the toners of Examples 1 to 10 and of Comparative Examples 1 to 3 was mixed with a carrier to form a developer having a toner density of 6 wt %. The resultant developers were evaluated for charge stability, fixing performance, anti-separation performance, anti-offset performance, anti-stress performance and image density. The results are also listed in Table 3 as below.

The carrier was prepared as follows.

Preparation of Carrier

A flask equipped with a stirrer, a condenser, a thermometer, a nitrogen inlet tube and a drip feeder was charged with 100 parts by weight of methyl ethyl ketone, to which the following solution was added dropwise under a nitrogen atmosphere at 80° C. over the course of 2 hours. The solution was prepared by dissolving 36.7 parts by weight of methyl methacrylate, 5.1 parts by weight of 2-hydroxyethyl methacrylate, 58.2 parts by weight of 3-methacryloxypropyl tris(trimethylsiloxy)silane, and 1 part by weight of 1,1'-azobis(cyclohexane-1-carbonitrile) in 100 parts by weight of methyl ethyl ketone. The resultant mixture was matured to form a resin solution.

The resin solution was admixed with isophorone diisocyanate/trimethylolpropane adduct (IPDI/TPM system: NCO%=6.1%), as a crosslinking agent, in a manner to provide a molar ratio of 1:1 between the OH of the resin and the NCO of the crosslinking agent. Then, the resultant mixture was diluted with methyl ethyl ketone to form a coating resin solution having a solid content of 3 wt %.

Calcined ferrite powder having a volume average particle size of 30 μm was used as a core material. A spiller coater (commercially available from Okadaseiko Co., Ltd.) was used to apply the above coating resin solution to the core material in a manner to provide an amount of coating resin of 1.5 wt %. The core material thus coated was dried and then, was sintered in a hot-air circulating oven at 160° C. for 1 hour so as to form the carrier. The carrier had a volume average particle size of 36 μm and an electric resistance of about 3×10610 Ωcm.

The charge stability of the individual toners was evaluated as follows. A 30 g sample of each of the developers prepared as described above was allowed to stand under low-temperature, low-humidity environment (10° C., 15%) for 24 hours, whereas a 30 g sample of each developer was allowed to stand under high-temperature, high-humidity environment (30° C., 85%). Each developer sample was charged to a 50 cc polyethylene vessel and was agitated by a ball mill which was operated at 120 rpm for 5 minutes. Thereafter, the electric charge of each toner was determined by a blow-off method. There was determined a difference between the electric charges of the toners allowed to stand under the low-temperature, low-humidity environment and under the high-temperature, high-humidity environment. The charge stability was evaluated based on the following criteria: ○ represents a toner having an absolute difference value of less than 7 μC/g; Δ represents a toner having an absolute difference value of 7 μC/g or more and less than 8 μC/g; × represents a toner having an absolute difference value of 8 μC/g or more.

The anti-separation performance of the above toners was examined as follows. Each of the above developers was used in a digital copier provided with an oil-less fixing device (DIALTA Di350 commercially available from Minolta Co., Ltd.). The copier was operated to fix, to a recording paper sheet, a 1.5 cm×1.5 cm solid image having a toner adhesion of 2.0 mg/cm$^2$. The fixing temperature was varied from 120° C. to 170° C. in steps of 2° C. The recording sheet was folded along the center of the image portion to evaluate the image separation by visual observation. The lowest fixing temperature was defined by a temperature intermediate a fixing temperature associated with a minor image separation and the lowest possible temperature to provide image fixation absolutely free from separation. The anti-separation performance was evaluated based on the following criteria: ⊙ represents a toner achieving a lowest fixing temperature of less than 142° C.; ○ represents a toner achieving a lowest fixing temperature of 142° C. or more and less than 146° C.; Δ represents a practically acceptable toner achieving a lowest fixing temperature of 146° C. or more and less than 152° C.; and × represents a practically unacceptable toner having a lowest fixing temperature of 152° C. or more.

The anti-offset performance of the above toners was examined as follows. Each of the above developers was used in the aforesaid digital copier (DIALTA Di350 commercially available from Minolta Co., Ltd.) for producing a copy of a halftone image. The speed of the fixing system of the copier was set to ½ of the normal speed whereas the fixing temperature was varied from 130° C. to 190° C. in steps of 5° C. The resultant copies were examined for offset by visual observation so as to determine a temperature associated with the offset occurrence. The anti-offset performance was evaluated based on the following criteria: ⊙ represents a toner having an offset occurrence temperature of 168° C. or more; ○ represents a toner having an offset occurrence temperature of 160° C. or more and less than 168° C.; Δ represents a practically acceptable toner having an offset occurrence temperature of 155° C. or more and less than 160° C.; and × represents a practically unacceptable toner having an offset occurrence temperature of less than 155° C.

The anti-stress performance of the above toners was examined as follows. Each of the above developers was used in the digital copier (DIALTA Di350 commercially available from Minolta Co., Ltd.) for continuously printing an image on 100,000 white sheets. Thereafter, the photosensitive member was examined for the adhesion of the toner microparticles to the surface thereof. The anti-stress performance was evaluated based on the following criteria: ○ represents a toner entailing no adhesion of the toner microparticles; Δ represents a toner entailing a partial adhesion of the toner microparticles but not forming a thin toner film; and × represents a toner entailing the adhesion of the toner microparticles in the form of a thin film.

The image density of the individual toners was examined as follows. The above copier was used to produce a copy of a 1.5 cm×1.5 cm solid image having a toner adhesion of 2.0 mg/cm$^2$. The resultant image was determined for the reflectance optical density I.D. by means of a Macbeth reflection densitometer (commercially available from GretagMacbeth Inc.). The image density was evaluated based on the following criteria: ⊙ represents a toner providing an I.D. of 1.4 or more; ○ represents a toner providing an I.D. of 1.3 or more and less than 1.4; Δ represents a toner providing an I.D. of less than 1.3; and × represents a toner providing an I.D. of less than 1.1.

TABLE 3

| | THERMOSTABIILTY | CHARGE STABIILTY | ANTI-SEPARATION PERFORMANCE | ANTI-OFFSET PERFORMANCE | ANTI-STRESS PERFORMANCE | IMAGE DENSITY |
|---|---|---|---|---|---|---|
| EXAMPLE 1 | ○ | ○ | ⊙ | ⊙ | ○ | ○ |
| EXAMPLE 2 | ○ | ○ | ○ | ○ | ○ | ⊙ |
| EXAMPLE 3 | ○ | ○ | ⊙ | ⊙ | ○ | ○ |
| EXAMPLE 4 | ○ | ○ | ○ | ○ | ○ | ⊙ |
| EXAMPLE 5 | ○ | ○ | ⊙ | ⊙ | ○ | ⊙ |
| EXAMPLE 6 | ○ | ○ | ○ | ⊙ | ○ | ⊙ |
| EXAMPLE 7 | ○ | ○ | ⊙ | ⊙ | ○ | ○ |
| EXAMPLE 8 | ○ | ○ | ⊙ | ⊙ | ○ | ○ |
| EXAMPLE 9 | ○ | ○ | ○ | ○ | ○ | ⊙ |
| EXAMPLE 10 | ○ | ○ | ⊙ | ⊙ | ○ | ⊙ |
| COMPARATIVE EXAMPLE 1 | Δ | X | X | ○ | X | ○ |
| COMPARATIVE EXAMPLE 2 | ○ | ○ | X | Δ | ○ | Δ |
| COMPARATIVE EXAMPLE 3 | Δ | Δ | ○ | ⊙ | Δ | ○ |

As apparent from the results, all the toners of Examples 1 to 10 are excellent in the thermostability, charge stability, anti-separation performance, anti-offset performance, anti-stress performance and image density, the toners each including the core particles formed with the coating layer containing the wax or colorant in the dry system.

In contrast, the toner of Comparative Example 1 including the core particles free from the coating layer is poor in the thermostability, charge stability, anti-separation performance and anti-stress performance. The toner of Comparative Example 2 including the core particles coated with the coating layer of the resin is poor in the anti-separation performance, anti-offset performance and image density. The toner of Comparative Example 3 is poor in the thermostability, charge stability and anti-stress performance, the toner including the core particles formed with the coating layer of the resin containing the wax in the wet system.

Although the present invention has been fully described by way of examples, it is to be noted that various changes and modifications will be apparent to those skilled in the art.

Therefore, unless otherwise such changes and modifications depart from the scope of the present invention, they should be construed as being included therein.

What is claimed is:

1. A toner comprising core particles containing a resin and a colorant, a first coating layer formed over the core particles, and a second coating layer formed over said first coating layer, wherein said first coating layer is formed in a dry system using at least one type of coating particles selected from the group consisting of wax-containing resin microparticles containing a resin and a wax, and colorant-containing resin microparticles containing a resin and a colorant, the coating particles fusion-bonded to the surface of said core particles.

2. The toner as claimed in claim 1, wherein a wax content of said first coating layer is 1 to 50 wt%.

3. The toner as claimed in claim 1, wherein a colorant content of said first coating layer is 0.5 to 15 wt%.

4. The toner as claimed in claim 1, wherein the weight of the first coating layer is 3 to 30 parts by weight based on 100 parts by weight of said core particles.

5. The toner as claimed in claim 1, wherein a wax content of said first coating layer is 1 to 10 wt%.

6. The toner as claimed in claim 1, wherein said second coating layer is formed in a dry system.

7. The toner as claimed in claim 1, wherein a wax content of the overall coating layers is 1 to 50 wt%.

8. The toner as claimed in claim 1, wherein a colorant content of the overall coating layers is 0.5 to 15 wt%.

9. The toner as claimed in claim 1, wherein the weight of the overall coating layers is 3 to 30 parts by weight based on 100 parts by weight of said core particles.

10. A toner comprising core particles containing a resin and a colorant, a first coating layer formed over the core particles, and a second coating layer formed over said first coating layer, wherein said first coating layer is formed in a dry system using at least one type of coating particles selected from the group consisting of wax microparticles and colorant microparticles attached to the surface of the core particles; and coating particles of resin microparticles fusion-bonded onto the attached coating particles.

11. The toner as claimed in claim 10, wherein a wax content of said first coating layer is 1 to 50 wt%.

12. The toner as claimed in claim 10, wherein a colorant content of said first coating layer is 0.5 to 15 wt%.

13. The toner as claimed in claim 10, wherein the weight of the first coating layer is 3 to 30 parts by weight based on 100 parts by weight of said core particles.

* * * * *